US006068242A

United States Patent [19]

Kingery

[11] Patent Number: 6,068,242

[45] **Date of Patent: *May 30, 2000**

[54] UNITARY, RIDGED AND RATCHETED PULLEY BLOCK

[76] Inventor: Gerald M. Kingery, P.O. Box 1412, Gilbert, Ariz. 85234

[ * ] Notice: This patent issued on a continued prosecution application filed under 37 CFR 1.53(d), and is subject to the twenty year patent term provisions of 35 U.S.C. 154(a)(2).

[21] Appl. No.: 08/947,088

[22] Filed: Oct. 8, 1997

Related U.S. Application Data

[63] Continuation of application No. 08/813,863, Mar. 7, 1997, which is a continuation of application No. 08/595,754, Feb. 2, 1996, which is a continuation of application No. 08/232,491, Apr. 25, 1994, abandoned.

[51] Int. Cl.[7] ..... B66D 3/04

[52] U.S. Cl. ..... 254/391; 254/409; 254/902

[58] Field of Search ..... 254/371, 390, 254/391, 409, 411, 403, 902

[56] References Cited

U.S. PATENT DOCUMENTS

| | | | |
|---|---|---|---|
| 492,550 | 2/1893 | Ferrall . | |
| 649,634 | 5/1900 | Fischer | 254/391 |
| 1,111,118 | 9/1914 | Williamson . | |
| 1,372,900 | 3/1921 | Olinger | 254/409 |
| 1,535,791 | 4/1925 | Raeburn | 254/390 |
| 2,194,679 | 3/1940 | Suter | 188/65.1 |
| 2,553,630 | 5/1951 | Capetta | 188/82.7 |
| 2,802,366 | 8/1957 | Borner | 74/230.5 |
| 2,922,310 | 1/1960 | Anderson | 74/230.3 |
| 3,255,997 | 6/1966 | Ferdig | 254/192 |
| 3,516,642 | 6/1970 | Pomagalski et al. | 254/167 |
| 3,524,626 | 8/1970 | Pomagalski et al. | 254/167 |
| 3,622,689 | 11/1971 | Sparks | 174/168 |
| 3,714,838 | 2/1973 | Gilson | 74/230.24 |
| 4,580,766 | 4/1986 | Woodgate | 254/371 |
| 4,603,839 | 8/1986 | Ekman et al. | 254/329 |
| 4,640,496 | 2/1987 | Van Hoomissen et al. | 254/415 |
| 5,368,281 | 11/1994 | Skyba | 254/391 |

FOREIGN PATENT DOCUMENTS

| | | | |
|---|---|---|---|
| 96429 | 12/1983 | European Pat. Off. | 254/371 |
| 0096429 | 12/1983 | European Pat. Off. | 254/371 |
| 615802 | 1/1927 | France | 254/391 |
| 627023 | 9/1927 | France . | |
| 2757-033 | 6/1979 | Germany | 254/390 |
| 682553 | 11/1952 | United Kingdom . | |

OTHER PUBLICATIONS

"Rope Ratchet" instructional sheet with artist's depictions of use of the ratchet, Carolina North Manufacturing Inc., Photocopy of this instruction sheet is attached. No date avaliable.

*Primary Examiner*—Donald P. Walsh
*Assistant Examiner*—Emmanuel M. Marcelo
*Attorney, Agent, or Firm*—Cahill, Sutton & Thomas, P.L.C.

[57] ABSTRACT

A ratchet for use with a cord includes a pair of opposed tear drop shaped members defining a one piece housing for rotatably supporting a one piece ratchet spool, a pivotally mounting a thumb release and supporting an angularly displacable hook. Circular cavities are disposed within the members to rotatably support corresponding bosses extending from opposed sides of the spool. A plurality of studs, one of which provides support for the hook, extend from one member into corresponding cavities of the other member and are sonically welded or otherwise permanently fixed therein. A steel pin, having opposed ends inserted into cavities in the opposed members, mounts the thumb release and an associated spring.

32 Claims, 2 Drawing Sheets

UNITARY, RIDGED AND RATCHETED PULLEY BLOCK

This is a continuation of patent application Ser. No. 08/813,863, filed Mar. 7, 1997 by GERALD M. KINGERY, and entitled "UNITARY, RIDGED AND RATCHETED PULLEY BLOCK"; which is a continuation application of Ser. No. 08/595,754, filed Feb. 2, 1996, by GERALD M. KINGERY, and entitled "UNITARY, RIDGED AND RATCHETED PULLEY BLOCK"; which is a continuation application of Ser. No. 08/232,491, filed Apr. 25, 1994, entitled "Ratchet", now abandoned.

BACKGROUND OF THE INVENTION

1. Field of the Invention

The present invention relates to ratchets and, more particularly, to a ratchet for use with a chord and having a small parts count.

2. Description of Related Art

Ratchets, used with cords such as rope, metallic cables and the like, include a spool about which the cord is partially wrapped. Circumferentially located teeth positionally fixed with the spool cooperate with a pawl to permit rotation of the spool in one direction to tighten the cord and prevent rotation in the other direction to bring about gripping of the cord by the spool when a force is applied to the cord. The pawl usually includes a thumb release to permit selective rotation of the spool in either direction. A hook or other securing member extends from the ratchet to permit anchoring of the ratchet. Known ratchets include many parts for the ratcheting function, supporting structure for the spool, the thumb release and the hook. Such large parts count increases the time and costs attendant manufacture and assembly. Unless each of the various parts are formed of non-corroding elements, corrosion in harsh environments, such as sea water, will significantly shorten the useful operating life of the ratchet. The operating surfaces of the cord engaging spool usually abrade and destructively compress the cord resulting in reduced tensile strength and possible catastrophic failure of the cord after a short period of use. The armature supporting the spool is generally of relatively small diameter which imposes significant forces per unit area of the supporting housing and results in a likelihood of catastrophic failure.

SUMMARY OF THE INVENTION

A pair opposed members having studs extending therebetween from one member into engagement with cavities in the other member are sonically welded or otherwise permanently secured in place to form the housing of a ratchet. A spool includes a pair of wheels are mechanically secured and aligned with one another with the junction therebetween being sonically welded or otherwise permanently formed. The spool further includes circular bosses disposed on opposed sides to serve in the manner of journals. Circular cavities within opposed members of the housing receive the bosses to rotatably support the spool within the housing. A pin is mounted within opposed corresponding cavities in the members to rotatably support a thumb release having a pawl cooperating with teeth formed in the spool. A rod extending from one of the members and welded into a cavity in the other member supports a hook for suspending the ratchet. A plurality of curved ribs are formed on the surface of each wheel in facing relationship to one another. The ribs of the two wheels are radially interleaved with one another to mechanically grip a cord by forcing it into a serpentine like configuration upon application of a pulling force upon one of a cord length extending from the ratchet when rotation of the spool is prevented by interference of the pawl with the teeth. By application of the pulling force upon the other cord length, rotation of the spool is accommodated by the pawl. By forming the parts of the ratchet from high strength plastic that can be formed into the desired shape by molding and using stainless steel or other non-corroding material for the thumb release supporting pin and the hook, deterioration of the ratchet due to corrosion will be prevented.

It is therefore the primary object of the present invention to provide a non-corroding ratchet having a low parts count.

Another object of the present invention is to provide a low parts count ratchet to reduce manufacturing and assembly costs.

Yet another object of the present invention is to provide a ratchet usable in harsh environments without fear of deterioration.

Still another object of the present invention is to provide a ratchet having mold formed primary plastic elements.

A further object of the present invention is to provide a ratchet assemblable by sonic welding.

A yet further object of the present invention is to provide a spool for a ratchet, which spool has a large diameter supporting journal to reduce the load density of forces imposed.

A still further object of the present invention is to provide a spool for a ratchet having a pair of wheels mechanically aligned with one another and welded to one another to ensure their positional relationship.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
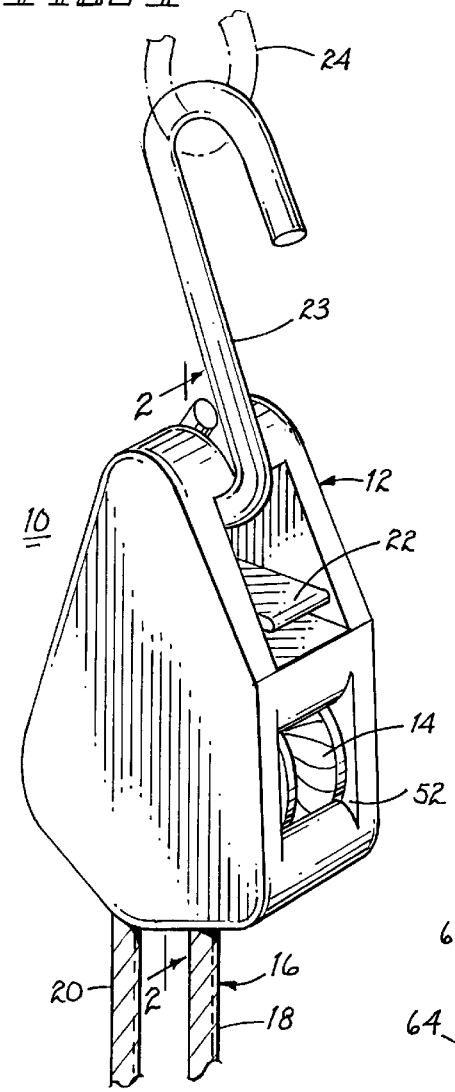
FIG. 1 is a perspective view of a ratchet.

A ratchet 10, illustrated in FIG. 1, includes a housing 12 of moldable plastic material, which material is of sufficient robustness to withstand the loads imposed. Material suitable may include Nylon, Delrin, or any of other known or to be developed plastic materials having high strength characteristics. A spool 14, rotatably mounted within housing 12, supports a cord 16 partially wrapped thereabout and having ends 18, 20 extending from the bottom of the ratchet. A thumb release 22 includes a pawl interferingly engaging with teeth formed as part of spool 14 to prevent rotation of the spool in one direction and yet accommodate rotation of the spool in the other direction. A hook 23 extends from the upper end of housing 12 to secure the ratchet to an anchor, or the like, as represented by ring 24. As noted from FIG. 1, the plan form of ratchet 10 is essentially tear drop shaped to provide a lateral balance from the point of suspension of the ratchet.

Figure 2:
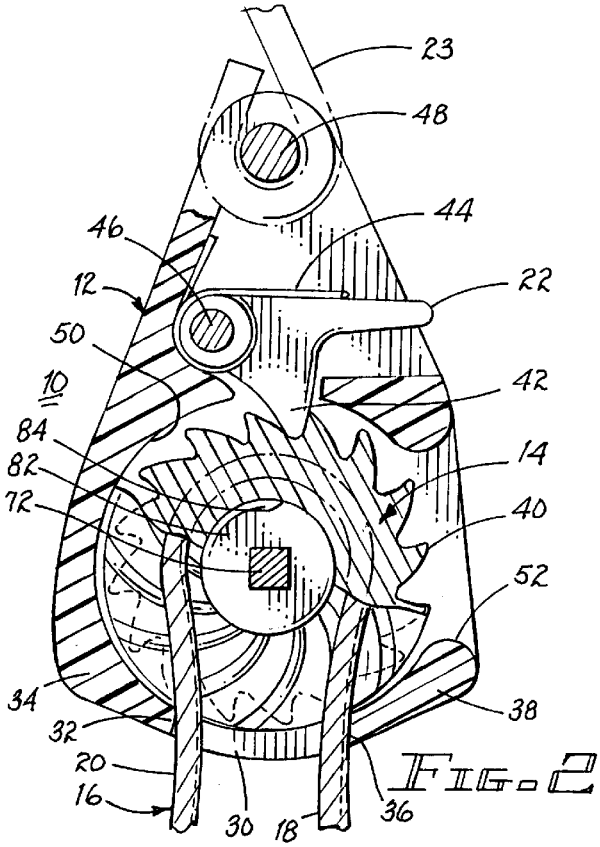
FIG. 2 is a cross-sectional view taken along lines 2—2, as shown in FIG. 1.
Figure 3:
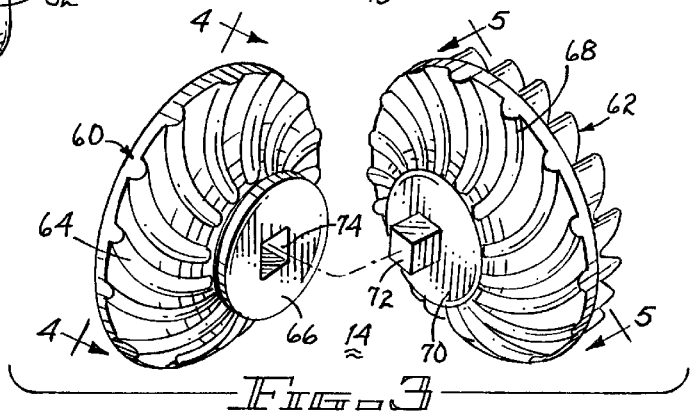
FIG. 3 is an exploded view of the spool rotatably mounted within the ratchet.

Further details attendant the structure and operation of the ratchet will be described with respect to FIG. 2. The bottom of ratchet 12 includes a slotted opening 30 defined by the terminal end 32 of end wall 34 and terminal end 36 of end wall 38. Cord 16 is partially wrapped about spool 14 with lengths 18 and 20 exiting through opening 30. Preferably, the length of opening 30, defined by terminal ends 32, 36 is less than the diameter of the part of the cord looped about spool 14 to urge the cord radially inwardly about the spool upon the application of pulling forces upon lengths 18 and 20 to mechanically engage the cord with the spool and prevent slippage therebetween. The spool includes a plurality of teeth 40 selectively engagable by pawl 42 of thumb release 22 to prevent rotation of spool 14 in one direction; counter clockwise as illustrated in FIG. 2. A coil spring 44 biases pawl 42 of thumb release 22 into engagement with the teeth. Upon lifting of the thumb release, or moving it in the counter clockwise direction as shown in FIG. 2, disengages the pawl from teeth 40 and spool 14 is free to rotate in either direction. A pin 46, mounted within housing 12, pivotally supports thumb release 22. A rod 48, formed as part of the housing 12, supports hook 23.

To secure cord 16 with ratchet 10, the terminal end of the cord is inserted through opening 30 into the left side (with reference to FIG. 2) of spool 14. Curved interior wall 50, forming in part a cavity within which the spool is housed, will guide the terminal end of the cord about the spool. Insertion of the cord will be enhanced by manually rotating the spool in the clockwise direction by manipulating the spool through opening 52 of the housing. The terminal end of the cord is brought out from within the housing through opening 30. The resulting engagement is illustrated in FIG. 2.

Figure 6:
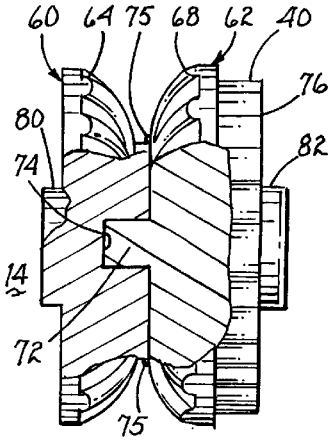
FIG. 6 is a partial cross-sectional view of the spool.
Figure 4:
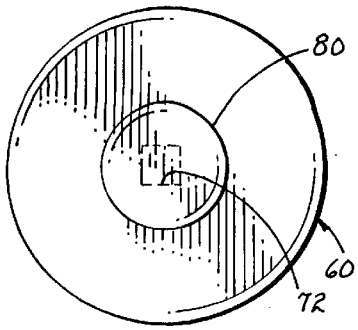
FIG. 4 is an end view taken along lines 4—4, as shown in FIG. 3.
Figure 5:
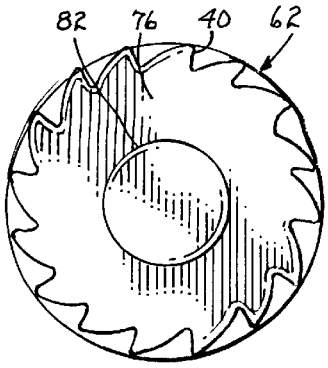
FIG. 5 is an end view taken along lines 5—5, as shown in FIG. 3.

Referring jointly to FIGS. 3 to 6, details attendant spool 14 will described. The spool includes wheels 60, 62. Wheel 60 includes a plurality of curved ribs 64 extending outwardly from hub 66. Similar curved ribs 66 extending outwardly from hub 70 are formed in wheel 62. It is preferable that the ribs of one wheel be offset or interleaved with the ribs of the other wheel to force the cord disposed therebetween into a serpentine configuration to increase the mechanical interference between the cord and the spool and prevent slippage therebetween without unduly squeezing the cord and causing damage to some of the strand of the cord. To ensure proper alignment between ribs 64 and 68, a key 72 extends from hub 70 for mating with a key way 74 in hub 66. The key and key way are oriented to engage one another and upon such engagement interleave ribs 64 and 68, as illustrated in FIG. 6. Hubs 66 and 70, along with key 72 and key way 74 may be sonically welded, as represented by numeral 75, to have spool 14 become a one piece unit; other attachment means, such as chemical welding, adhesive, etc. can also be used. Wheel 62 includes a disk 76 having a plurality of teeth 40, as discussed above, forming its perimeter.

Spool 14 is rotatably mounted within housing 12 by a boss 80 extending laterally from wheel 60 and by a boss 82 extending laterally from wheel 62, which bosses serve in the manner of journals. Each of these bosses nests within corresponding circular cavities formed in housing 12. Cavity 84, for supporting boss 82 is illustrated in FIG. 2.

Figure 7:
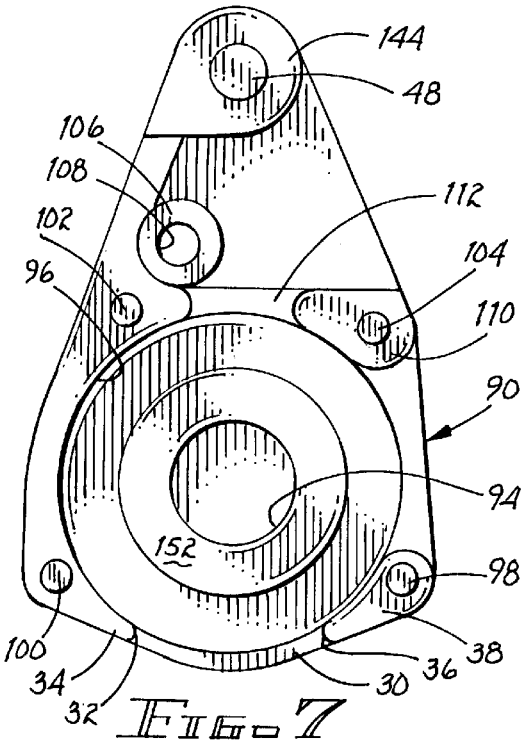
FIG. 7 is a plan view of the interior of one of the members forming the housing of the ratchet.
Figure 8:
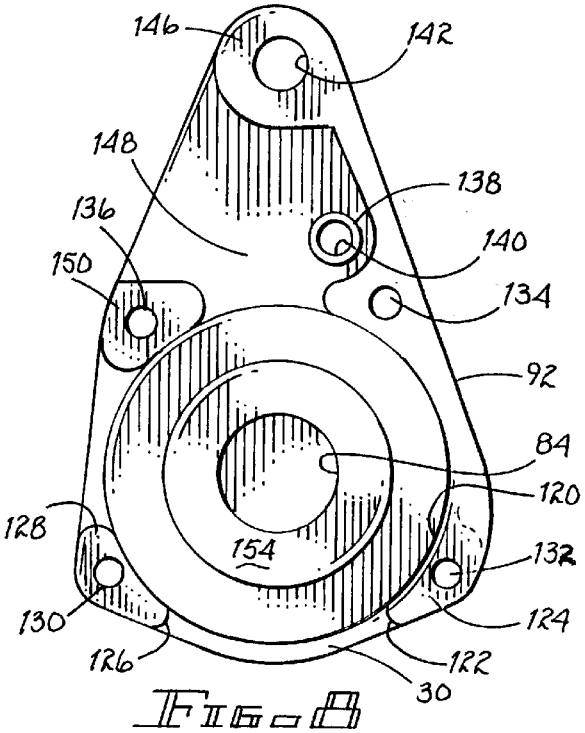
FIG. 8 is a plan view of the other member forming the housing of the ratchet.
Figure 9:
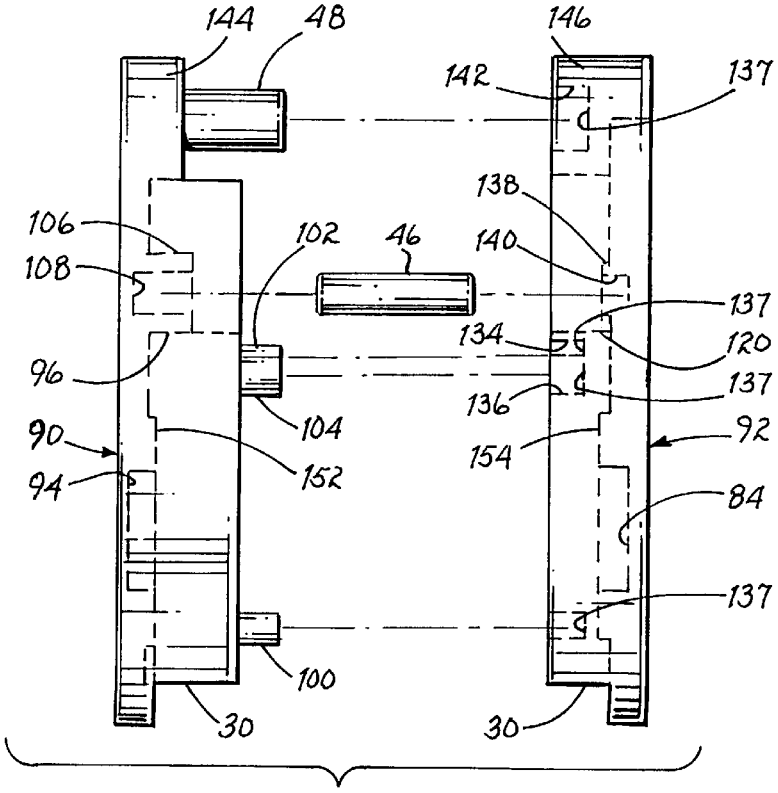
FIG. 9 is an exploded side view of the members forming the housing of the ratchet.

Referring jointly to FIGS. 7, 8 and 9, details attendant the structure of housing 12 will be described in detail. The housing is formed by a pair of members 90, 92 which are sonically welded or otherwise permanently secured to one another, as will be described in further detail below. Member 90 defines one half of opening 30 disposed between terminal ends 32, 36 of one half of end walls 34, 38. Circular cavity 94 is formed to receive boss 80 of spool 14. A further cavity represented in part by cylindrical wall 96 receives wheel 60 of spool 14. Studs 98, 100, 102, and 104 are formed as part of member 90 and extend outwardly therefrom. A further stud, which becomes rod 48, is formed as part of and extends from member 90. A boss having a cavity 108 formed therein, receives and supports one end of pin 46. Opening 52 (see FIG. 1 and FIG. 2) extends between end wall 38 and land 110 supporting stud 104. Space 112, disposed between land 110 and end wall 34, serves as an aperture or opening through which pawl 42 extends.

Member 92 includes a circular cavity 84 (see FIG. 2) for receiving boss 82 of spool 14. A cylindrical wall 120 defines in part a cavity within which wheel 62 is located. Terminal end 122 of end wall 124 and terminal end 126 of end wall 128 define, in part, opening 30. A plurality of recesses or circular cavities 130, 132, 134 and 136 are dimensioned to receive and mate with studs 98, 100, 102 and 104, respectively. Upon such mating, the end walls of opposing members 90, 92 will be adjacent one another. Permanent attachment of number 90 with member 92 can be achieved by sonically welding each of the studs with its respective cavity, as represented by numeral 137 attendant each of the stud receiving cavities. Other permanent fixation, such as chemical welding, adhesive, etc. can also be used. A boss 138, having a cavity 140 formed therein, receives and supports one end of pin 46. Cavity 142 is dimensioned to receive rod 48. As may be noted from FIGS. 7 and 8, significantly sized lands 144 and 146 are formed about the base of stud 48 and cavity 142 to ensure adequate support for the opposed ends of rod 48 and to provide the requisite degree of robustness for the intended and expected uses of ratchet 10. Space 148 between land 150 and end wall 124 serves as part of the aperture or opening through which pawl 42 of the thumb release extends. As illustrated, lands in the form of rings 152, 154 may be formed about cavities 94, 84, respectively, to provide more mass and supporting strength for the bosses of spool 14 journalled therewithin.

After assembly, it may be noted that the only parts of ratchet 10 are housing 12, spool 14, thumb release 22, coil spring 14 and hook 23. Thus, ratchet 10, compared to the known prior art, has a very small number of parts or a very low parts count. Of these parts, wheels 60, 62 members 90, 92 and thumb release 22 may be molded, which molding is relatively inexpensive. The remaining parts, pin 46 and coil spring 44 are of standard manufacture and therefore relatively inexpensive to produce. Assembly of wheels 60, 62 to form spool 14 and sonically welding or otherwise forming a permanent attachment of the wheels, is relatively inexpensive. After mounting of spool 14, thumb release 22, spring 44 and pin 46 and engaging hook 23 with rod 48, the studs extending between the members are sonically welded or otherwise permanently secured with their respective cavities, which assembly process is performable by well known techniques and is relatively inexpensive.

With the low parts count, the likelihood of failure of any given part and hence failure of ratchet 10 is significantly reduced. The permanent nature of the assembly process prevents a user from disassembling the ratchet or removing any part thereof without destroying the ratchet. Such impediment to disassembly or modification increases and enhances the useful life of the ratchet. Should a failure occur, the ratchet should be discarded without an attempt of repair to ensure that failure resulting in potentially catastrophic results does not occur.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. A ratchet for use with a cord, said ratchet comprising in combination:

a) first and second members affixed to one another to form a housing;

b) a spool having first and second wheels secured to one another to mechanically capture the cord, said spool including a circular boss formed on each of said first and second wheels and extending from opposed sides of said spool for journalling said spool;

c) a cavity having a cylindrical side wall and a surface of the respective one of said first and second members intersecting said side wall and formed in a respective one of said first and second members for receiving and rotatably supporting the respective one of said bosses of said spool within said housing; and d) a thumb release pivotally mounted within said housing for engaging said spool to prevent rotation of said spool in one direction.

2. The ratchet as set forth in claim 1 including a plurality of studs extending from said first member and a plurality of cavities disposed in said second member for receiving corresponding ones of said studs to secure said first and second members with one another.

3. The ratchet as set forth in claim 2 including welds for securing said studs within said cavities.

4. The ratchet as set forth in claim 2 wherein said housing, said spool, said studs and said thumb release are of plastic material.

5. The ratchet as set forth in claim 1 including a key extending from said first wheel and a key way disposed in said second wheel for mechanically orienting said first and second wheels with one another and for preventing rotation of said first and second wheels independent of one another.

6. The ratchet as set forth in claim 5 including a first hub for supporting said key and a second hub within which said key way is formed.

7. The ratchet as set forth in claim 6 including a weld for securing said first and second hubs to one another.

8. The ratchet as set forth in claim 5 wherein said thumb release includes a pawl and including a disk formed as part of one of said first and second wheels and a plurality of teeth defining the perimeter of said disk for selective engagement by said pawl.

9. The ratchet as set forth in claim 8 including a pin for supporting said thumb release and opposed cavities formed in said first and second members for supporting said pin within said housing.

10. The ratchet as set forth in claim 9 including a coil spring disposed about said pin for biasing said pawl against said teeth.

11. The ratchet as set forth in claim 5 including a plurality of curved ridges disposed on each of said first and second wheels for frictionally gripping the cord placed therebetween.

12. The ratchet as set forth in claim 11 wherein said ridges of said first wheel are interleaved with said ridges of said second wheel.

13. The ratchet as set forth in claim 1 including an opening disposed in said housing for accommodating ingress and egress of the cord.

14. The ratchet as set forth in claim 1 including a hook extending from said housing for attaching said ratchet to an anchor.

15. The ratchet as set forth in claim 14 including a rod disposed in said housing for supporting said hook.

16. The ratchet as set forth in claim 15 including a pin for supporting said thumb release and opposed cavities formed in said first and second members for supporting said pin within said housing.

17. The ratchet as set forth in claim 16 including a coil spring for biasing said thumb release into engagement with said spool.

18. A ratchet as set forth in claim 1 wherein each of said bosses is an integral part of the respective one of said first and second wheels.

19. A ratchet as set forth in claim 18 wherein each of said bosses is of uniform density therethrough.

20. A ratchet, said ratchet comprising in combination:

a) a housing, said housing including a pair of opposed cavities formed therein, each cavity of said pair of cavities including a cylindrical side wall and a surface intersecting said side wall;

b) a spool, said spool including a pair of circular bosses extending in from opposed sides of said spool for mating engagement with said pair of cavities to rotatably support said spool within said housing; and c) a thumb release for selectively restricting rotation of said spool.

21. The ratchet as set forth in claim 20 wherein said housing, said spool and said thumb release are fabicated from plastic material.

22. The ratchet as set forth in claim 20 including a hook extending from said housing for attaching said ratchet to an anchor.

23. A ratchet as set forth in claim 20 wherein each of said pair of bosses is an integral part of said spool.

24. A ratchet as set forth in claim 23 wherein each of said pair of bosses is of uniform density therethrough.

25. A ratchet for use with a cord, said ratchet comprising in combination:

a) first and second members affixed to one another to form a housing;

b) a spool including first and second wheels having a common axis of rotation and secured to one another to mechanically capture the cord and means for preventing independent rotation of said first wheel relative to said second wheel, said first wheel including a first cylindrical boss centered upon the axis of rotation and extending in a first direction, said second wheel including a second cylindrical boss centered upon the axis of rotation and extending in a second direction opposite from the first direction;

c) first and second cavities formed in respective ones of said first and second members for receiving and rotatably supporting the respective ones of said first and second bosses within said housing, each cavity of said first and second cavities including a cylindrical side wall and a surface of the respective one of said first and second members intersecting said side wall; and d) a pivotally mounted thumb release for selectively engaging said spool to prevent rotation of said spool in one direction.

26. The ratchet as set forth in claim 25 including a hook extending from said housing for attaching said ratchet to an anchor.

27. A ratchet as set forth in claim 25 wherein each of said first and second bosses is an integral part of the respective one of said first and second wheels.

28. A ratchet as set forth in claim 27 wherein each of said first and second bosses is of uniform density therethrough.

29. A ratchet for use with a cord, said ratchet comprising in combination:

a) first and second members affixed to one another to form a housing;

b) a spool including first and second wheels having a common axis of rotation and secured to one another to mechanically capture the cord, said first wheel including a key extending therefrom along the axis of rotation, said second wheel including a keyway extending along the axis of rotation for receiving said key to prevent independent rotation of said first wheel relative to said second wheel;

c) means for rotatably supporting said first and second wheels within said housing, said supporting means including a circular boss formed on each of said first and second wheels and extending from opposed sides of said spool for journalling said spool and a cavity having a cylindrical side wall and a surface intersecting said side wall and formed in each of said first and second members for receiving and rotatably supporting the respective one of said bosses; and d) a pivotally mounted thumb release for selectively engaging said spool to prevent rotation of said spool in one direction.

30. The ratchet as set forth in claim 29 wherein each of said key and said keyway is rectangular in cross-section.

31. A ratchet as set forth in claim 29 wherein each of said bosses is an integral part of the respective one of said first and second wheels.

32. A ratchet as set forth in claim 31 wherein each of said bosses is of uniform density therethrough.

* * * * *